US008552368B1

(12) United States Patent
Wood

(10) Patent No.: US 8,552,368 B1
(45) Date of Patent: Oct. 8, 2013

(54) TRACE ATMOSPHERIC GAS ANALYZER LOW PRESSURE IONIZATION SOURCE

(71) Applicant: Lockheed Martin Corporation, Bethesda, MD (US)

(72) Inventor: John A. Wood, Bethlehem, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/722,586

(22) Filed: Dec. 20, 2012

(51) Int. Cl.
*H01J 49/10* (2006.01)

(52) U.S. Cl.
CPC ..... *H01J 49/10* (2013.01)
USPC ..... 250/288; 250/423 R

(58) Field of Classification Search
USPC ..... 250/288, 423 R, 424, 423 P, 423 F, 427
See application file for complete search history.

(56) References Cited

U.S. PATENT DOCUMENTS

| | | | | |
|---|---|---|---|---|
| 5,572,137 | A * | 11/1996 | Jones | 324/464 |
| 5,773,833 | A * | 6/1998 | Hsi | 250/382 |
| 6,326,615 | B1 | 12/2001 | Syage et al. | |
| 6,329,653 | B1 | 12/2001 | Syage et al. | |
| 6,750,449 | B2 | 6/2004 | Marcus | |
| 7,109,476 | B2 | 9/2006 | Hanold et al. | |
| 7,476,852 | B2 | 1/2009 | Bonne et al. | |
| 7,642,510 | B2 * | 1/2010 | McEwen | 250/288 |
| 8,044,343 | B2 | 10/2011 | Arii et al. | |
| 2005/0056776 | A1 | 3/2005 | Willoughby et al. | |
| 2006/0284103 | A1 | 12/2006 | Syage | |
| 2009/0127453 | A1 | 5/2009 | Ding et al. | |
| 2010/0096542 | A1 | 4/2010 | Whitehouse et al. | |
| 2010/0096546 | A1 | 4/2010 | Ewing et al. | |
| 2011/0036977 | A1 | 2/2011 | Denton et al. | |

OTHER PUBLICATIONS

Li, Jianwei, et al., Presentation slides entitled "Portable, Fast GC/Qit-Tof MS for Chem/Bio Detection", Syagen Technology, Inc., Jan. 20, 2005, 24 pages.
Hill, Steve, Press Release entitled "Morpho Detection Completes Acquisition of Syagen Technology", Jul. 26, 2011, 2 pages.

* cited by examiner

*Primary Examiner* — Kiet T Nguyen
(74) *Attorney, Agent, or Firm* — Marsh Fischmann & Breyfogle LLP

(57) ABSTRACT

A low pressure ionization source and method for detecting trace atmospheric gases with an instrument employing ionized target substances. The ionization source and method may employ electric potential ionization, photoionization, and/or ionization by alpha and/or beta particle irradiation. In one embodiment, an ionization source includes a fixture securable to the instrument, a chamber within the fixture, two sample entrance passageways into the chamber, an electrode receiver hole, a lamp receiver hole, and an ionized sample exit hole from the chamber. A gas sample entering the chamber via a sample entrance passageway is ionized by one of an electric potential induced by an electrode received in the electrode receiver hole or a light beam provided by a photoionization lamp received in the lamp receiver hole. At least a portion of the ionized gas sample exits the chamber via the sample exit hole to a detector/analyzer of the instrument.

25 Claims, 15 Drawing Sheets

TRACE ATMOSPHERIC GAS ANALYZER LOW PRESSURE IONIZATION SOURCE

FIELD OF THE INVENTION

The present invention relates generally to the identification of trace atmospheric gases, and more particularly to ionizing substances in a gas sample for identification by a detector/analyzer unit of an instrument.

BACKGROUND OF THE INVENTION

Instruments such as tandem mass spectrometry (MS/MS) instruments may be used to detect the presence of particular substances such as trace atmospheric gases that may be present in a gas sample. The gas sample may be obtained in a variety of manners including, for example, by collecting air near an individual or luggage or other articles associated with an individual, by collecting air near or within a vehicle, a cargo container, or a room, by heating a swab passed over an individual, an individual's luggage or other articles, or the surfaces of a vehicle, cargo container or room, or by monitoring the ambient air to detect plumes of substances emitted from nearby or distant sources and transported to the monitoring equipment by the wind or by diffusion. To detect trace atmospheric gases in the sample, the detector/analyzer unit of such instruments may employ ion separation and thus require that the gas sample be ionized. However, different substances are ionized more effectively by different modes of ionization.

SUMMARY OF THE INVENTION

Accordingly, a low pressure ionization source that is usable with an instrument employing ionized target substances to detect trace atmospheric gases in a gas sample and a method of ionizing a gas sample for detection of trace atmospheric gases in the gas sample using an instrument are provided. The instrument may, for example, comprise any instrument employing ion separation as an element of identifying the presence of one or more target substances in an inlet gas sample stream. In this regard, the instrument may, for example, comprise a mass spectrometry (MS) instrument, a tandem mass spectrometry (MS/MS) instrument, an ion mobility spectrometry instrument, and/or an ion drift spectrometry instrument. The low pressure ionization source and method may employ different modes of ionizing substances in the gas sample including ionization resulting from an electric potential, photoionization and/or ionization resulting from irradiation by alpha and/or beta particles.

In one aspect, a low pressure ionization source includes a fixture securable to the instrument, a chamber within the fixture, one or more sample entrance passageways extending from an outer surface of the fixture to the chamber, an electrode receiver hole extending from a first end of the fixture to the chamber, a lamp receiver hole extending from an outer surface of the fixture to the chamber, and an ionized sample exit hole extending from the chamber to a second end of the fixture. The sample exit hole may be proximal to a detector/analyzer unit of the instrument when the fixture is secured to the instrument. The electrode receiver hole is configured to receive an electrode therein, and the lamp receiver hole is configured to receive a photoionization lamp therein. The gas sample may enter the chamber via a sample entrance passageway and is ionized by a selected one of an electric potential and a light beam. The electric potential may be induced in the chamber between at least a portion of the fixture and an electrode receivable in the electrode receiver hole, and the light beam may be introduced in the chamber by a photoionization lamp receivable in the lamp receiver hole. At least a portion of the ionized gas sample exits the chamber via the sample exit hole toward the detector/analyzer of the instrument.

The low pressure ionization source may be configured to maintain an operating pressure in the chamber of less than about 10 Torr. To facilitate achieving such chamber operating pressure it may be desirable to vary the effective diameter of the sample exit hole. In this regard, the ionization source may also include an orifice plate receiver hole formed in the second end of the fixture and one or more orifice plates, with each orifice plate being securable in the orifice plate receiver hole and including an orifice opening therethrough aligned with the ionized sample exit hole when the orifice plate is secured in the orifice plate receiver hole. There may be a plurality of interchangeable orifice plates, with each plate having an incrementally different diameter orifice opening and/or there may be a single orifice plate with a continuously variable size orifice opening.

The fixture may also include a pressure controller receiver hole extending from an outer surface of the fixture to the chamber. The pressure controller receiver hole is configured to receive a pressure controller therein for further facilitating maintaining the desired operating pressure within the chamber.

The ionization source may also include an electrode receiver hole plug and a lamp receiver hole plug. When the ionization source is to be operated the electrode mode, it may be desirable to remove the photoionization lamp and replace it with the lamp receiver hole plug, and when the ionization source is to be operated the photoionization mode, it may be desirable to remove the electrode and replace it with the electrode receiver hole plug. In some embodiments, it may also be possible to leave both the electrode and the photoionization lamp secured in their respective receiver holes of the fixture regardless of the mode in which the ionization source is operated.

The fixture may also include one or more radiation source plug receiver holes extending from an outer surface of the fixture to the chamber. Each radiation source plug receiver hole is configured to receive a radiation source plug therein for irradiating the gas sample. The gas sample may be irradiated directly as it enters the chamber by passing the sample through the radiation source plug. The gas sample may also be irradiated indirectly by passing a reactant gas through the radiation source plug and then into the chamber where it mixes with the gas sample. In this regard, the ionization source may be considered to achieve true low pressure chemical ionization (LPCI) of the gas sample. The ionization source may employ ionizing irradiation in conjunction with electrode ionization and/or photoionization of the gas sample. The ionization source may also employ ionizing irradiation by itself without electrode ionization and/or photoionization of the gas sample.

The ionization source may be configured for securing to a particular instrument and/or to a variety of instruments. For example, the fixture may include a flange formed thereon proximal to the second end, with the flange specifically adapting the fixture for being releasably secured to a particular instrument. By way of further example, the ionization source of may also include one or more interchangeable adaptor rings securable to the fixture proximal to the second end. Each adaptor ring may be configured to adapt the fixture for being releasably secured to a particular instrument and removed from the fixture to permit securing of a differently configured adaptor ring to the fixture for securing the fixture to a different model instrument.

The fixture may be manufactured in various manners including, for example, machining the fixture from a single piece of material. In this regard, the material comprising the fixture, as well as other components of the ionization source (e.g., adaptor ring(s), orifice plate(s), electrode and lamp receiver hole plug(s), radiation plug(s)) is desirably a material chemically resistant to interaction with target analytes and ions produced from the target analytes. In this regard, the material may comprise, for example, Hastelloy C-22 or 316 stainless steel.

The low pressure ionization source may be configured such that the light beam from the photoionization lamp is aimed into the chamber so that the light beam intersects the gas sample at or substantially adjacent to the point of entry of the gas sample into the chamber. Illuminating the gas sample at or substantially adjacent to the point of entry into the chamber maximizes efficiency of the photoionization achieved in the chamber by exposing all or nearly all of the entering gas sample to the ionizing light. The low pressure ionization source may also be configured to avoid exposing the gas sample to the ionizing light beam in a higher pressure zone such as, for example, prior to entering the chamber from the sample entrance passageway used during photoionization operation. Avoiding photoionization of the gas sample in a high pressure zone reduces the efficiency of collisional transfer of ionization. Highly efficient collisional transfer of ionization may not be desirable in some instances because it can result in only one target substance (the most stable ion) out of many target substances simultaneously present in the gas sample being detected.

The low pressure ionization source is further advantageous in that the fixture itself, or particularly a portion of the fixture surrounding the chamber, may serve as a complimentary electrode to an electrode received in the electrode receiver hole. For example, an electrode received in the electrode receiver hole may be maintained at a higher electrical potential (e.g. positive) and the fixture, or a portion thereof, may be maintained at a lower electrical potential (e.g. negative) relative to one another during electrode operation of the ionization source. By way of further example, an electrode received in the electrode receiver hole may be maintained at a lower electrical potential (e.g. negative) and the fixture, or a portion thereof, may be maintained at a higher electrical potential (e.g. positive) relative to one another during electrode operation of the ionization source. It may also be possible to switch the relative electrical potentials of an electrode received in the electrode receiver hole and the fixture, or a portion thereof, during electrode of the ionization source. Utilizing the fixture, or a portion thereof, as the complimentary electrode means that the gas sample enters the chamber and the ionized substances exit the chamber through openings in the same electrode (e.g., the fixture or portion thereof that is the complimentary electrode).

In another aspect, a method of ionizing a gas sample includes securing a fixture to the instrument. The fixture may includes a chamber defined therein, one or more sample entrance passageways extending from an outer surface of the fixture to the chamber, an electrode receiver hole extending from a first end of the fixture to the chamber, a lamp receiver hole extending from an outer surface of the fixture to the chamber, and an ionized sample exit hole extending from the chamber to a second end of the fixture. The sample exit hole may be proximal to a detector/analyzer unit of the instrument upon securing the fixture to the instrument. The method also includes installing at least one of one of an electrode in the electrode receiver hole and a photoionization lamp in the lamp receiver hole, introducing a gas sample into the chamber via a sample entrance passageway, and ionizing at least a portion of the gas sample entering the chamber by operating a selected one of the electrode and the photoionization lamp, wherein the electrode induces an electric potential in the chamber between at least a portion of the fixture and the electrode and the photoionization lamp introduces a light beam in the chamber. After being ionized at least a portion of the ionized gas sample exits from the chamber via the sample exit hole to the detector/analyzer unit of the instrument. The fixture may be configured such that when introducing a gas sample into the chamber via a sample entrance passageway, the gas sample is directed past the face of the photoionization lamp.

The method may also include installing an electrode receiver hole plug in the electrode receiver hole when an ionization lamp is to be selected for ionizing the gas sample, and installing a lamp receiver hole plug in the lamp receiver hole when an electrode is to be selected for ionizing the gas sample. The method may also include installing both of an electrode in the electrode receiver hole and a photoionization lamp in the lamp receiver hole, leaving the electrode in the electrode receiver hole when the ionization lamp is to be selected for ionizing the gas sample, and operating the electrode as a repeller when the ionization lamp is operated to ionize the gas sample.

The method may also include maintaining a pressure of about 10 Torr or less in the chamber during ionization of the gas sample. In this regard, the method may include installing a pressure controller in a pressure controller receiver hole extending from an outer surface of the fixture to the chamber, and operating the pressure controller to maintain a pressure of about 10 Torr or less in the chamber. The method may also include installing a selected one of a plurality orifice plates in an orifice plate receiver hole formed in the second end of the fixture, with each orifice plate including an orifice opening therethrough aligned with the ionized sample exit hole when installed in the orifice plate receiver hole and the diameter of the orifice opening varying incrementally from plate to plate within a desired range of diameters. The method may also include installing an orifice plate in an orifice plate receiver hole formed in the second end of the fixture, with the orifice plate including an orifice opening therethrough aligned with the ionized sample exit hole when installed in the orifice plate receiver hole and wherein a diameter of the orifice opening in the orifice plate being continuously variable over a desired range of diameters.

The method may also include installing a radiation source plug in a radiation source plug receiver hole extending from an outer surface of the fixture to the chamber. When a gas sample is introduced into the chamber, the gas sample may be irradiated either directly as it enters the chamber through the radiation source plug or indirectly via an irradiated reactant gas introduced into the chamber via the radiation source plug.

The method may also include aiming the light beam from the photoionization lamp into the chamber so that the light beam intersects the gas sample at or substantially adjacent to the point of entry of the gas sample into the chamber. The method may also include aiming the light beam from the photoionization lamp into the chamber in a manner that avoids photoionization of the gas sample in a high pressure zone.

Various refinements exist of the features noted in relation to the various aspects of the present invention. Further features may also be incorporated in the various aspects of the present invention. These refinements and additional features may exist individually or in any combination, and various features of the various aspects may be combined. These and other aspects and advantages of the present invention will be apparent upon review of the following Detailed Description when taken in conjunction with the accompanying figures.

DESCRIPTION OF THE DRAWINGS

For a more complete understanding of the present invention and further advantages thereof, reference is now made to the following Detailed Description, taken in conjunction with the drawings, in which.

DETAILED DESCRIPTION

Figure 1:
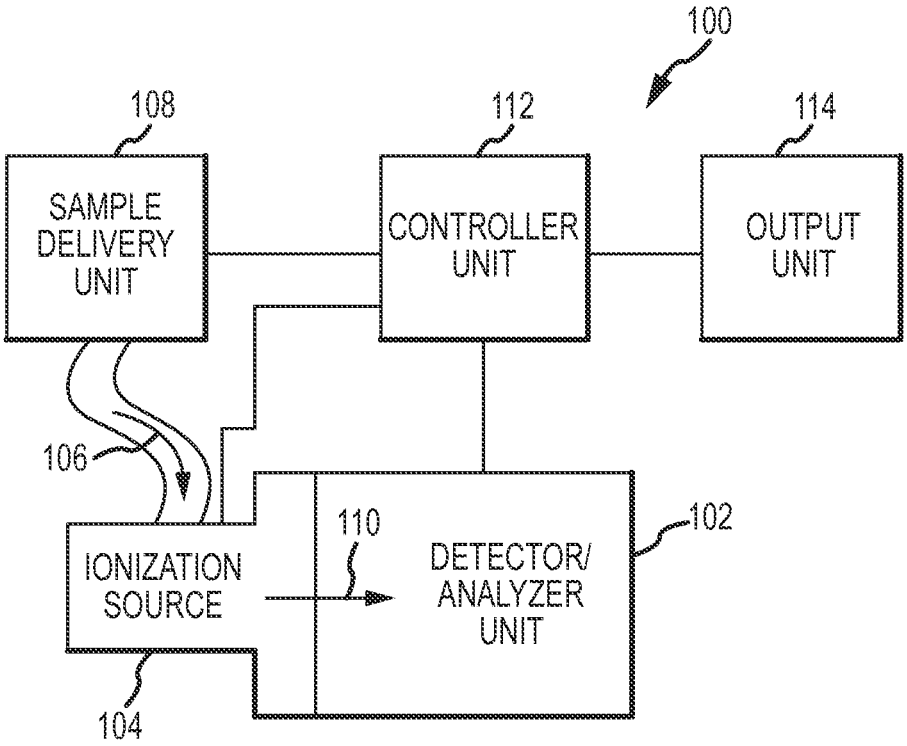
FIG. 1 is a block diagram of an exemplary instrument including an ionization source that ionizes substances in an inlet sample gas stream.

FIG. 1 is a block diagram of an exemplary instrument 100 that employs ion separation as an element of identifying the presence of one or more target substances in an inlet gas sample stream. In this regard, the instrument 100 may, for example, comprise a mass spectrometer, an ion mobility spectrometer, and/or an ion drift spectrometer. The instrument 100 includes a detector/analyzer unit 102 that detects/analyzes ionized substances directed into the detector/analyzer unit 102 from an ionization source 104. The ionization source 104 receives an inlet gas sample stream 106 from a sample delivery unit 108 and ionizes at least a portion of the inlet gas sample stream 106 to generate an outlet ionized gas sample stream 110 that is received by the detector/analyzer unit 102. Operation of the detector 102, ionization source 104, and/or sample delivery unit 108 may all be controlled by a controller unit 112 communicatively coupled thereto. The detector/analyzer unit 102 detects/analyzes the constituents of the outlet ionized gas sample stream 110. The controller unit 112 may also be communicatively coupled to an output unit 114 (e.g. a display and/or a printer) that outputs information regarding the constituents of the outlet ionized gas sample stream 110.

Figure 2A:
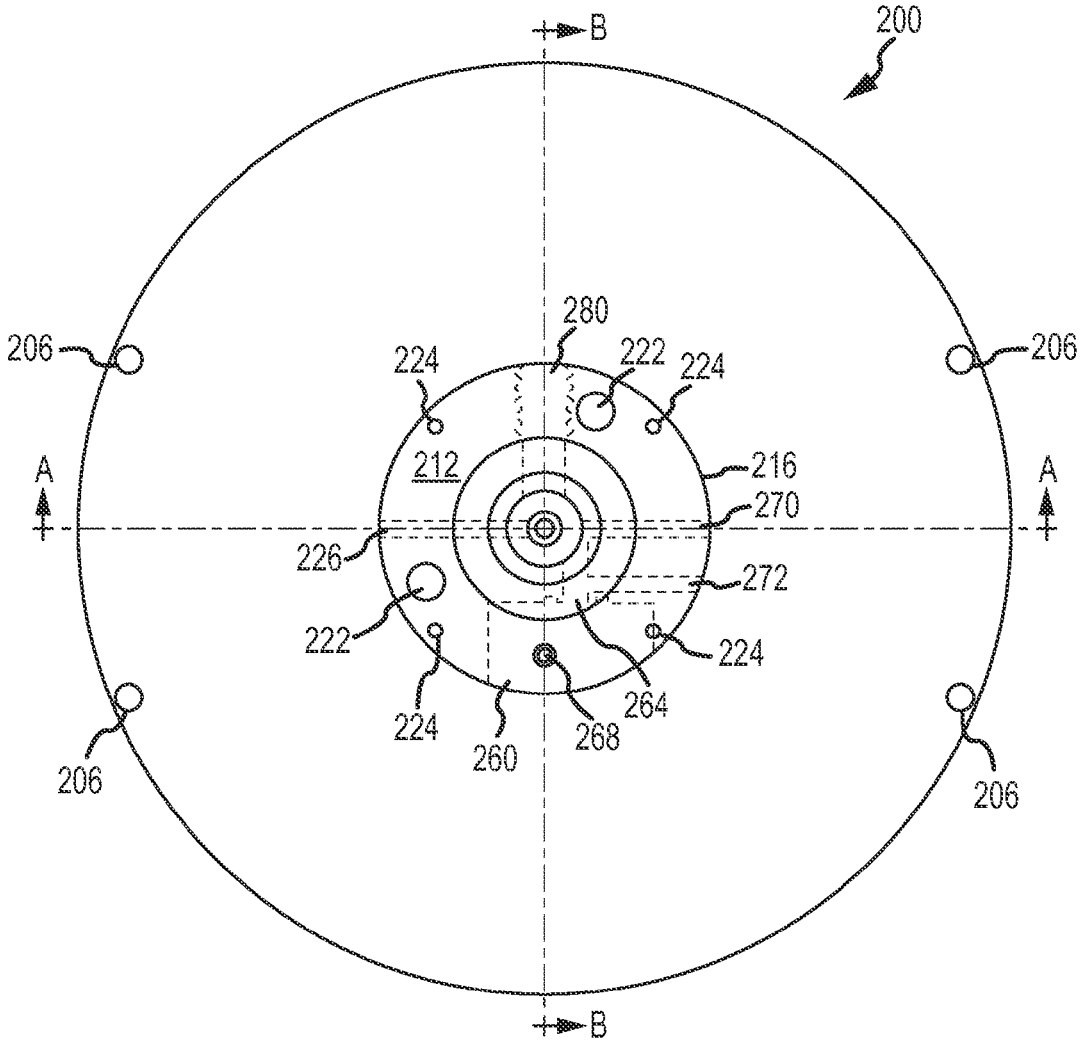
FIG. 2A is a top view of one embodiment of an ionization source.
Figure 2B:
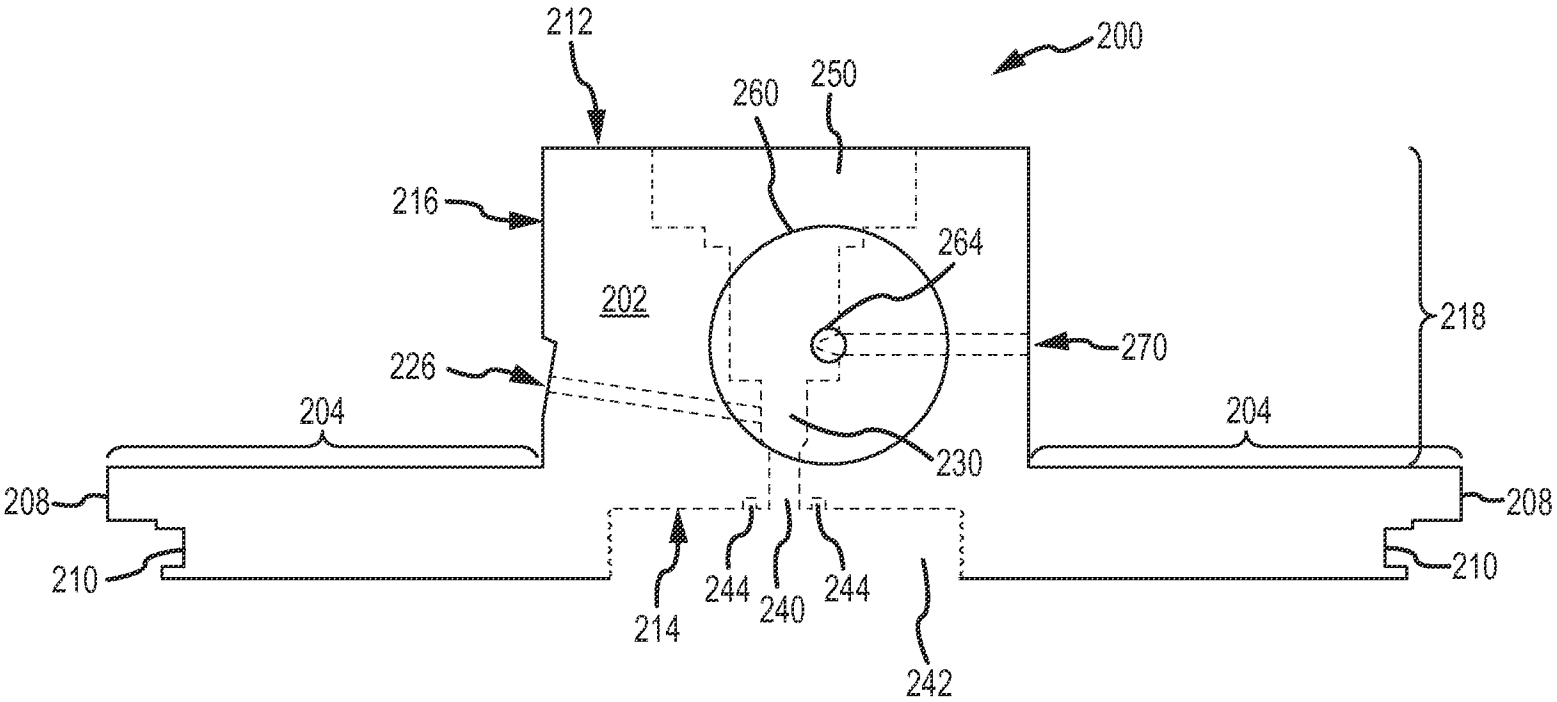
FIG. 2B is a side cross-sectional view of the ionization source taken along line A-A in FIG. 2A.
Figure 2C:
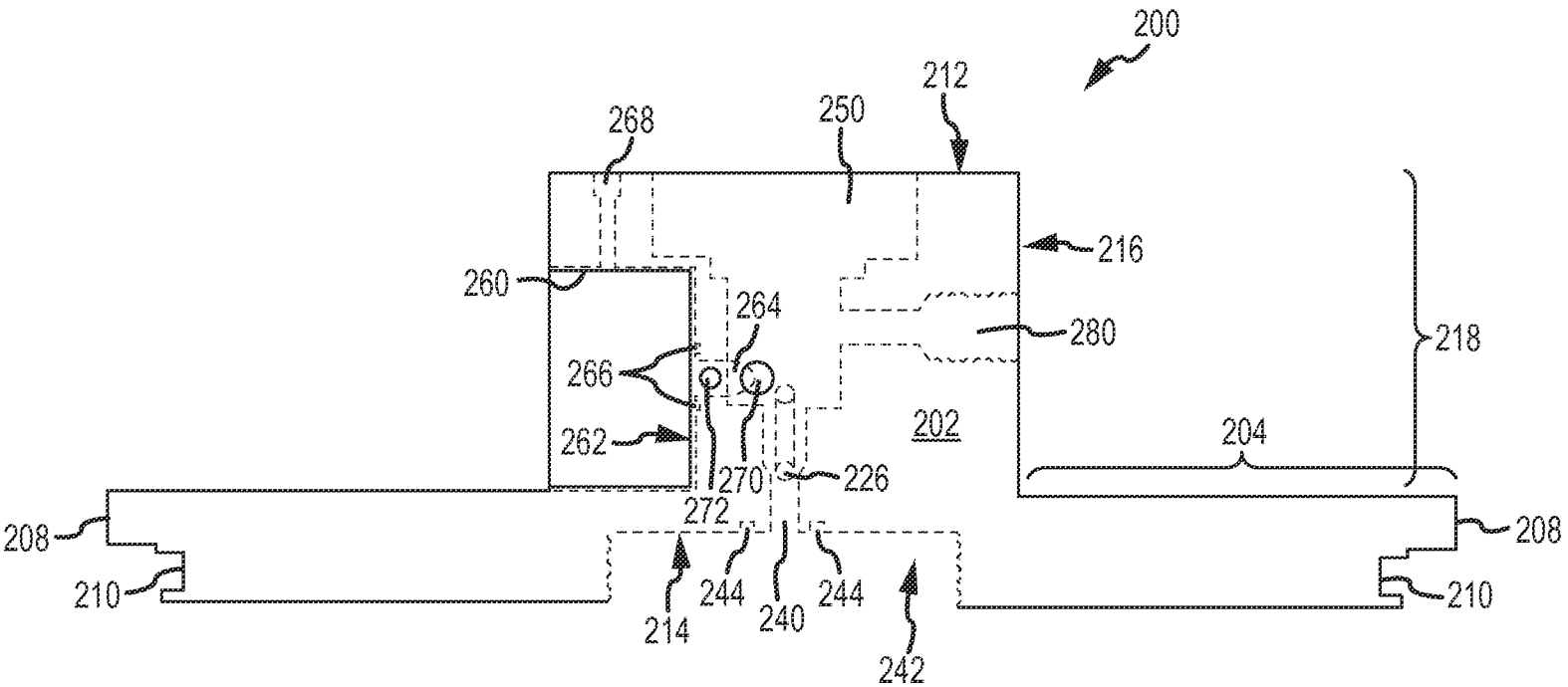
FIG. 2C is a side cross-sectional view of the ionization source taken along line B-B in FIG. 2A.

FIGS. 2A-2C show one embodiment of a low pressure ionization source 200. The low pressure ionization source 200 may be used as the ionization source of an instrument such as illustrated in FIG. 1. The low pressure ionization source 200 includes a fixture 202 that is releasably securable to the detector/analyzer of the instrument. In this regard, the fixture 202 includes an annular flange portion 204 having a plurality of holes 206 extending through the flange portion 206 near an outer edge 208 of the flange portion 204. The holes 206 may align with threaded holes in the detector/analyzer of the instrument so that the fixture 202 may be releasably secured to the detector/analyzer of the instrument by machine screws. This permits the low pressure ionization source 200 to be removed from the detector/analyzer when desired and re-secured to the detector/analyzer when desired. Additionally, the flange portion 204 may include a groove 210 formed in the outer edge 208 that receives a flexible o-ring for providing a tight seal between the fixture 200 and the detector/analyzer.

The fixture 202 includes a first end 212, a second end 214, and an outer lateral surface 216 extending between the first and second ends 212, 214. The lateral surface 216 may be curved such that it provides the fixture 202 with a generally cylindrically shaped main portion 218 between the first and second ends 212, 214, although in other embodiments, the outer lateral surface 216 may be configured such that the main portion 218 of the fixture 202 between the first and second ends 212, 214 has a non-circular cross-section (e.g., rectangular, hexagonal, star-shaped, etc.). The flange portion 204 is disposed proximal to the second end 214 of the fixture 202 such that the second end 214 of the fixture 202 is proximal to the detector/analyzer of the instrument when the fixture 202 is secured thereto. The flange portion 204, holes 206, outer edge 208 and groove 210 may, for example, be specifically configured such that the fixture 202 may be releasably secured to a particular model instrument. The flange portion 204, holes 206, outer edge 208 and groove 210 may also be specifically configured such that the fixture 202 may be releasably secured to the detector/analyzer of various other instruments. For example, the diameter of the of the flange portion 204 may be altered, the locations and number of the holes 206 may be changed, the thickness of the outer edge 208 may be altered, and/or the location of the groove 210 may be changed in other embodiments in order to fit other model instruments. The fixture 202 includes a plurality of primary holes 222 and a plurality of secondary holes 224 formed in the first end 212 of fixture 202 that extend down into the main portion 218 of the fixture 202.

The fixture 202 includes a first sample entrance passageway 226. The first sample entrance passageway 226 extends from the lateral surface 216 of the fixture 202 to a chamber 230 within the fixture 202. The first sample entrance passageway 226 provides passage for an inlet gas sample stream through the wall of the fixture 202 and into the chamber 230. A sample exit hole 240 extends from the chamber 230 toward the second end 214 of the fixture 202. The sample exit hole 240 permits ionized gas sample stream to exit the chamber 230.

The fixture 202 may also include an orifice plate receiver hole 242 formed in the second end 214 of the fixture 202. The orifice plate receiver hole 242 is configured to permit an orifice plate (not shown in FIGS. 2A-2B) such as shown in FIGS. 5A-5B or FIGS. 5C-5D to be installed in the second end 214 of the fixture 202.

The first sample entrance passageway 226 may be angled such that a central axis extending through the passageway 226 intersects the lateral surface 216 of the fixture 202 at a non-perpendicular angle. Angling the first sample entrance passageway 226 in this manner provides room for a tubing connector fitting (not shown in FIGS. 2A-2C) to be installed where the first sample entrance passageway 226 intersects the lateral surface 216 of the fixture 202 without interference from the flange portion 204 while still permitting the first sample entrance passageway 226 to intersect the surface of the chamber 230 near the sample exit hole 240. The tubing connector fitting may, for example, be a Valco fitting available from Valco Instruments Co. Inc., and the tubing connector fitting facilitates convenient connection of a sample delivery unit (not shown in FIGS. 2A-2C) to the fixture 202.

Figure 3A:
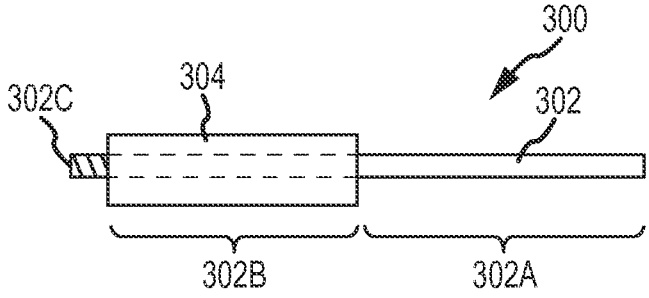
FIG. 3A is a side view of an exemplary electrode that may be installed in an ionization source such as shown in FIGS. 2A-2C.
Figure 3B:
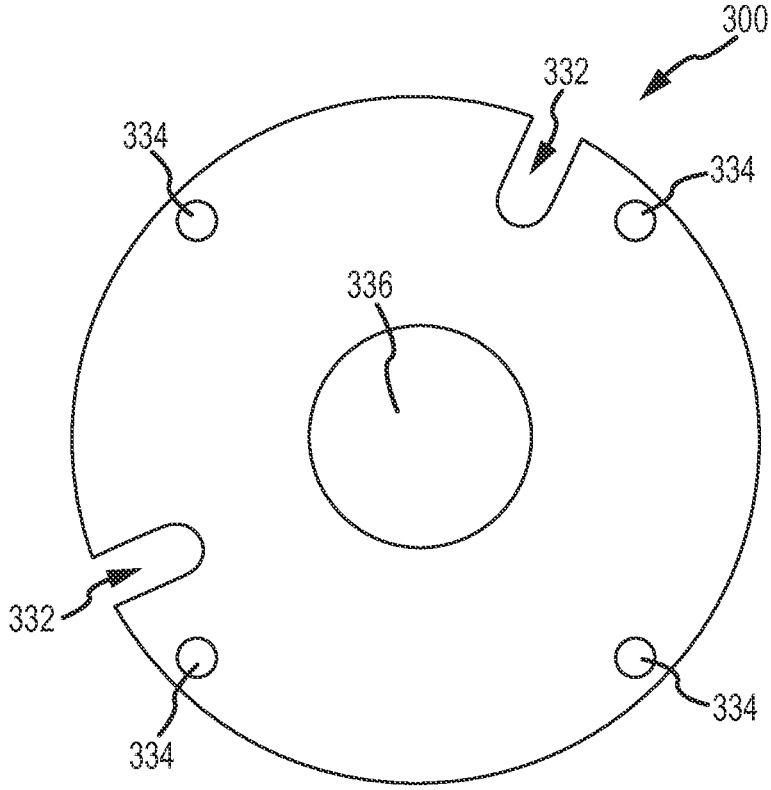
FIG. 3B is a top view of one embodiment of an electrode retainer that may be utilized to secure an electrode installed in an ionization source such as shown in FIGS. 2A-2C.

The fixture 202 also includes an electrode receiver hole 250. The electrode receiver hole 250 extends from the first end 212 of the fixture 202 toward the chamber 230. The electrode receiver hole 250 is configured to receive an electrode an exemplary electrode is illustrated in FIG. 3A) such that an operative end of the electrode extends into the chamber 230. In this regard, the electrode may, for example, comprise a glow discharge electrode. The electrode may be retained in the electrode receiver hole 250 by an electrode retainer such as shown in FIG. 3B. The electrode may be coupled via one or more control wires (not shown in FIGS. 2A-2C) to a controller unit (not shown in FIGS. 2A-2C) that controls operation of the electrode.

When operated in electrode mode (e.g. by applying an electric current to an electrode received in the electrode receiver hole 250), an electric potential is induced in the chamber 230 between the electrode and at least a portion of the fixture 202 (e.g., the main cylindrical portion 218). In this regard, the fixture 218 may be coupled by an electrical conductor to the controller and/or ground in order to serve as the complimentary electrode during operation of the ionization source 200. The electric potential ionizes substances in an inlet gas sample stream entering the chamber 230. In this regard, the inlet gas sample stream may preferably be introduced into the chamber 230 via the first sample entrance passageway 226 when it is to be ionized by an electric potential induced in the chamber 230 by an electrode installed in the electrode receiver hole 250.

Figure 4:
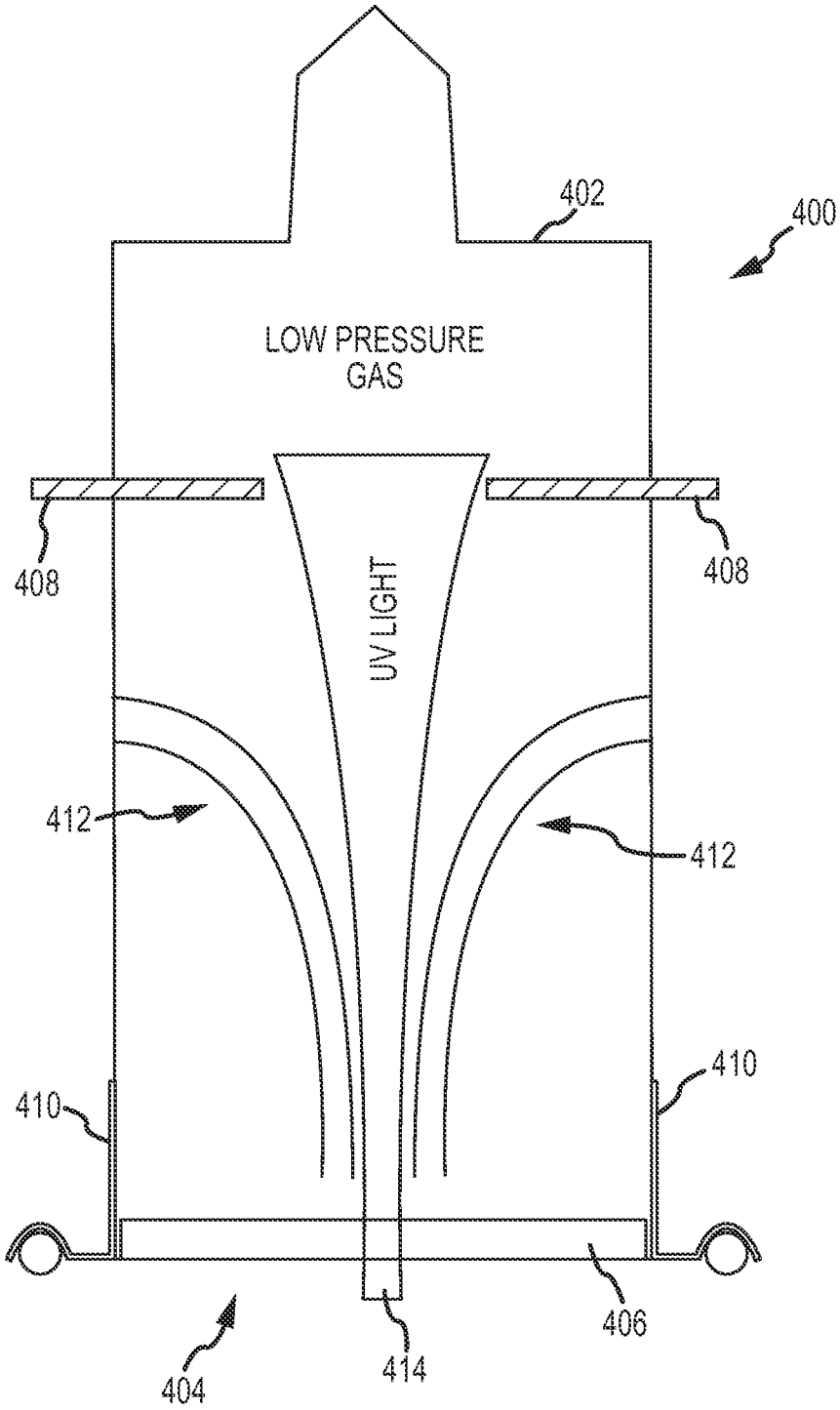
FIG. 4 is a side view of an exemplary photoionization lamp that may be installed in an ionization source such as shown in FIGS. 2A-2C.

The fixture 202 also includes a lamp receiver hole 260 and a second sample entrance passageway 270. The lamp receiver hole 260 extends from the lateral surface 216 of the fixture 202 toward the chamber 230. The lamp receiver hole 260 is configured to receive a photoionization lamp (not shown in FIGS. 2A-2C) such that an operative end of the photoionization lamp is directed toward chamber 230. In this regard, the photoionization lamp may, for example, comprise a photoionization lamp 400 such as depicted in FIG. 4. When installed, the lamp may seat against a lamp seating surface 262. A light entrance passageway 264 extends from the lamp receiver hole 260 into the chamber 230. An o-ring groove 266 around the light entrance passageway 264 may receive an o-ring (not shown in FIGS. 2A-2C) for providing a seal between the photoionization lamp and the lamp seating surface 262. The photoionization lamp may be held in place in the lamp receiver hole 260 by a set screw (not shown in FIGS. 2A-2C) threaded into a set screw hole 268 extending from the first end 212 of the fixture 202 to the side of the lamp retaining hole 260. The photoionization lamp may be coupled via one or more control wires (not shown in FIGS. 2A-2C) to a controller unit (not shown in FIGS. 2A-2C) that controls operation of the photoionization lamp. A tubing connector fitting (not shown in FIGS. 2A-2C) such as, for example, a Valco fitting available from Valco Instruments Co. Inc., may be installed where the second sample entrance passageway 270 intersects the lateral surface 216 of the fixture 202 to facilitate convenient connection of a sample delivery unit (not shown in FIGS. 2A-2C) to the fixture 202.

When operated, the photoionization lamp generates a light beam that is directed via the light entrance passageway 264 into the chamber 230 to ionize substances (e.g. gaseous or vapor phase substances) in the inlet gas sample stream entering the chamber 230. In this regard, the inlet gas sample stream may preferably be introduced into the chamber 230 via the second sample entrance passageway 270 when it is to be ionized by a light beam introduced into the chamber 230 by a photoionization lamp installed in the lamp receiver hole 260. Furthermore, the light entrance passageway 264 and the second sample entrance passageway 270 may preferably be oriented transverse (e.g. at 90 degrees) to one another with the their respective openings into the chamber 230 being located so that the light beam intersects the entering gas sample at or substantially adjacent to the point of entry of the gas sample into the chamber 230 from the second sample entrance passageway 270 and without a substantial portion of the light beam directly entering the second sample entrance passageway 270. This facilitates all or nearly all of an inlet sample gas stream entering the chamber 230 from the second sample entrance passageway 270 to be intersected by the light beam entering the chamber 230 from the light entrance passageway 264 to maximize efficiency of the photoionization achieved while avoiding undesirable photoionization of the gas sample in the higher pressure zone of the second sample entrance passageway 270.

Additionally, the ionization source 200 of FIGS. 2A-2C includes a purge channel 272 formed in the fixture 202. The purge channel 272 may run parallel to the second sample entrance passageway 270 and intersects the light entrance passageway 264. A tubing connector fitting (e.g., a Valco fitting) may be installed on the external end of the purge channel 272 for facilitating the coupling of the purge channel 272 via a hose or the like to a purge gas source (e.g. a tank). A purge gas (e.g., a gas with limited reactive characteristics such as helium or other inert gases) may be introduced via the purge channel 272 to clear the chamber 230 and clean the window of the photoionization lamp. The ability to clear the chamber 230 and clean the window of the photoionization lamp facilitates having both the photoionization lamp and the electrode remain in place regardless of whether the ionization source 200 is operated in electrode ionization mode or photoionization mode thus eliminating the need to remove one or the other and replace it with a plug depending upon the mode of operation of the ionization source 200.

In instances where the ionization source 200 is be used to produce ionized substances using an electric potential induced in the chamber 230 by an electrode installed in the electrode receiver hole 250, instead of having a photoionization lamp installed in the lamp receiver hole 260, a plug may be disposed in the lamp receiver hole 260 and the inlet gas sample stream may be directed from the sample delivery unit to the first sample entrance passageway 226. In instances where the ionization source 200 is be used to produce ionized substances using a light beam introduced by a photoionization lamp installed in the lamp receiver hole 260, instead of having a electrode installed in the electrode receiver hole 250, a plug may be disposed in the electrode receiver hole 250 and the inlet gas sample stream may be directed from the sample delivery unit to the second sample entrance passageway 270. In this regard, by incorporating an electrode receiver hole 250 in which an electrode may be releasably secured by an electrode retainer and a lamp receiver hole 260 in which a photoionization lamp may be releasably secured by a set screw in the set screw hole 268 into the fixture 202 rather than permanently positioning an electrode and a photoionization lamp into the fixture 202, the ionization source 200 may be conveniently changed between electrical potential and photonic ionizing modes of operation. The releasably securable nature of the electrode and photoionization lamp also allow these to be conveniently changed if they fail or if different models of the electrode and/or the photoionization lamp are desired for ionizing particular substances.

Instead of installing a plug in the electrode receiver hole 250 when the ionization source 200 is to be used to produce ionized substances using a light beam introduced by a photoionization lamp installed in the lamp receiver hole 260, it is also possible to install a repeller electrode in the electrode receiver hole 250. The repeller electrode essentially comprises a shorter version of a glow discharge electrode that would be installed in the electrode receiver hole 250 during electrode operation of the ionization source 200. An electric potential can be applied to the repeller electrode to push ionized substances toward the sample exit hole 240.

Additionally, when the ionization source 200 is operated in photoionization mode without removal of a glow discharge electrode from the electrode receiver hole 250, it is possible to use the glow discharge electrode as a repeller. In this regard, a lower electrical potential (e.g., between about 0.1V to 100V) in comparison to the electrical potential that would typically be used during electrode operation can be applied to the glow discharge electrode that remains in the electrode receiver hole 250 causing it to function as a repeller to drive ionized substances toward the sample exit hole 240.

Typically, it is desirable to operate the ionization source 200 under low pressure conditions. In this regard, the ionization source may be operated such that a pressure in the chamber 230 is about 10 Torr or less. The pressure in the chamber 230 may depend upon various factors including, for example, a pressure in the detector/analyzer unit of the instrument to which the ionization source is secured and the size of the opening in the orifice plate installed in the orifice plate receiver hole 242. Additionally, the fixture 202 may include a pressure controller receiver hole 280 that extends from the lateral surface 216 of the fixture 202 into the side of the chamber 230. A portion of the side of the pressure controller receiver hole 280 may be threaded for retaining a threaded pressure controller body (not shown in FIGS. 2A-2C) in the pressure controller receiver hole 280. The pressure controller body may operate (e.g., using a pump or the like) to maintain a desired pressure (e.g., about 10 Torr or less) in the chamber 230 during operation of the ionization source 200.

FIG. 3A depicts an exemplary electrode 300 that may be installed in the electrode receiver hole 250 of the fixture 202 of an ionization source 200 such as shown in FIGS. 2A-2C. The electrode 300 includes a conductor 302 and an insulator 304. The conductor 302 may include an exposed portion 302A that is not surrounded by the insulator 304, an insulated portion 302B that is surrounded by the insulator 304, and an exposed connection end 302C that extends beyond the insulated portion 302B. The insulator 304 may comprise a material (e.g. a ceramic material) that prohibits or substantially limits the flow of electrical current therethrough allowing the electrode 300 to be installed in the electrode receiver hole 226 without making electrical contact with the fixture 202. The conductor 302 may comprise an electrically conductive material (e.g. a metal) in the shape of a rod or the like having sufficient length so that the exposed end 302A of the conductor 302 extends substantially into the chamber 230 (e.g., to or nearly to the opening of the first sample entrance passageway 226) while the insulated end 302B of the conductor 302 is held in position at the first end 212 of the fixture 202 (e.g. by the electrode retainer 330 such as shown in FIG. 3B). An electrical conductor may be connected to the exposed connection end 302C of the conductive rode 302 for applying an electrical current to the electrode 300 during operation of the ionization source 200.

FIG. 3B shows an electrode retainer 330 that may be used to releasably secure an electrode in the electrode receiver hole 250 of the fixture 202 of an ionization source 200 such as shown in FIGS. 2A-2C. The electrode retainer 330 may be generally circular in cross-section with a diameter that is about the same as the diameter of the cylindrical portion of the fixture 202 that extends above the annular flange portion 204 of fixture 202. The electrode retainer 330 includes a plurality of slots 332, a plurality of secondary holes 334, and a central hole 336 formed through the electrode retainer 330. The slots 332 may be aligned with the primary holes 222 formed in the first end 212 of the fixture 202, the secondary holes 334 may be aligned with the secondary holes 224 in the first end 212 of the fixture 202, and the central hole 336 may be aligned with the electrode receiver hole 250 formed in the fixture 202 when the electrode retainer 330 is positioned overlying the first end 212 of the fixture 202.

FIG. 4 shows the general features of one embodiment of an exemplary photoionization lamp 400 that may be releasably secured in the lamp receiver hole 260 of the fixture 202 of an ionization source such as shown in FIGS. 2A-2C. The photoionization lamp includes a hollow body member 402 having an opening 404 at one end thereof. The opening 404 is covered with a window 406 that is transparent to ultraviolet (UV) light. The window 406 also seals the opening 404 to prevent a low pressure gas that is contained within the hollow body member 402 from escaping. A first electrode 408 extends through the walls of the hollow body member 402 into the hollow body member 402. The first electrode 408 is positioned nearer to an end of the hollow body member 402 opposite the opening 404. A second electrode 410 is fixed to the walls of the hollow body member 402 proximal to the opening 404. An electric current applied to the first electrode 408 excites particles of the low pressure gas within the hollow body member 402 causing the excited gas particles emit UV light. An electric current applied to the second electrode 410 establishes an electromagnetic field 412 that narrows the UV light into a focused beam 414. The focused UV light beam 414 exits the hollow body member 402 through the UV transparent window 406. The photoionization lamp 400 may be secured in the lamp receiver hole 260 of the fixture 202 of an ionization source such as shown in FIGS. 2A-2C set screw received in the set screw hole 268 with the UV transparent window 406 facing the chamber 230 so that the focused UV light beam 414 enters the chamber 230.

Figure 5A:
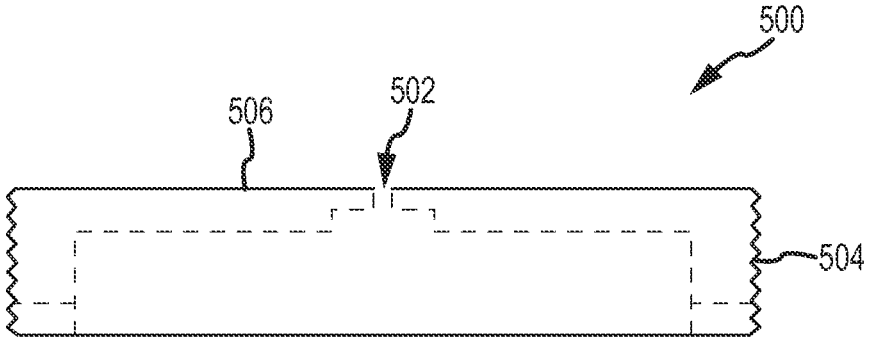
FIG. 5A is a side view of one embodiment of an orifice plate.
Figure 5B:
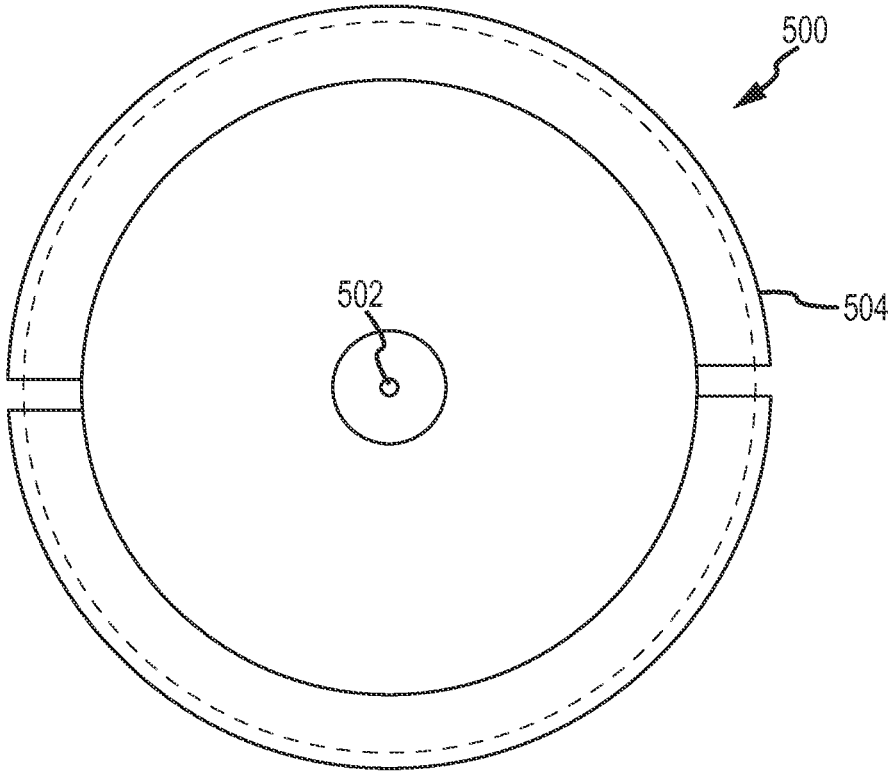
FIG. 5B is a bottom view of the orifice plate of FIG. 5A.

FIGS. 5A-5B show one embodiment of an orifice plate 500 that may be installed in the orifice plate receiver hole 242 of a fixture 202 such as shown in FIGS. 2A-2C. The orifice plate 500 includes an orifice opening 502 that is aligned with the sample exit hole 240 when the orifice plate 500 is installed in the orifice plate receiver hole 242 to permit ionized substances of the sample gas to exit the chamber 230 via the aligned sample exit hole 240 and orifice opening 502. An outer edge 504 of the orifice plate 500 may be configured for releasably securing the orifice plate 500 in the orifice plate receiver hole 242. In this regard, threads may be formed on the outer edge 504 of the orifice plate for mating with corresponding threads formed on a side of the orifice plate receiver hole 242. This allows the orifice plate 500 to be tightly secured in the orifice plate receiver hole 242. An o-ring disposed in an o-ring groove 244 formed in the second end 214 of the fixture 202 around the sample exit hole 240 may provide a seal between a top surface 506 of the orifice plate 500 and the second end 214 of the fixture 202 in order to prevent ionized substances of the gas sample from escaping around the outer edge 504 of the orifice plate 500.

The orifice plate 500 may also be removed from the orifice plate receiver hole 242 and another orifice plate 500 having a differently sized orifice opening 502 may be installed. A plurality of interchangeable orifice plates 500 each having a differently sized orifice opening 502 may be provided with the fixture 202. In this regard, the orifice plates 500 may have orifice openings 502 ranging in diameter from, for example, about 0.20 mm to about 2.00 mm. For example, a total of eighteen orifice plates 500 having orifice openings 502 ranging in diameter from about 0.20 mm to about 2.00 mm in 0.10 mm increments (e.g., 0.20, 0.30, 0.40 . . . 2.00 mm) may be provided.

Figure 5C:
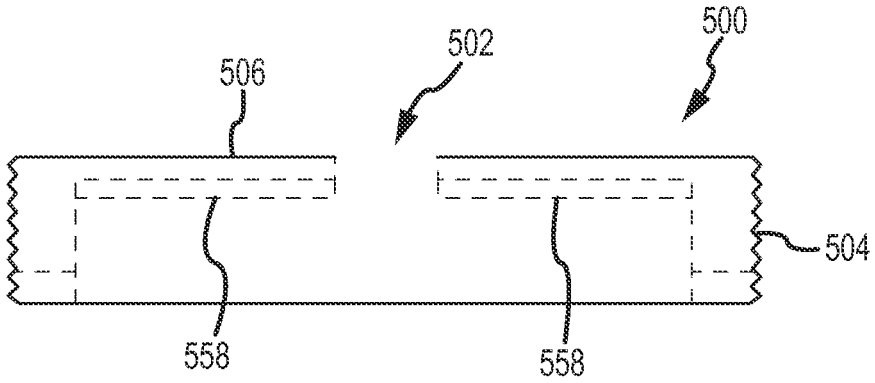
FIG. 5C is a side view of another embodiment of an orifice plate.
Figure 5D:
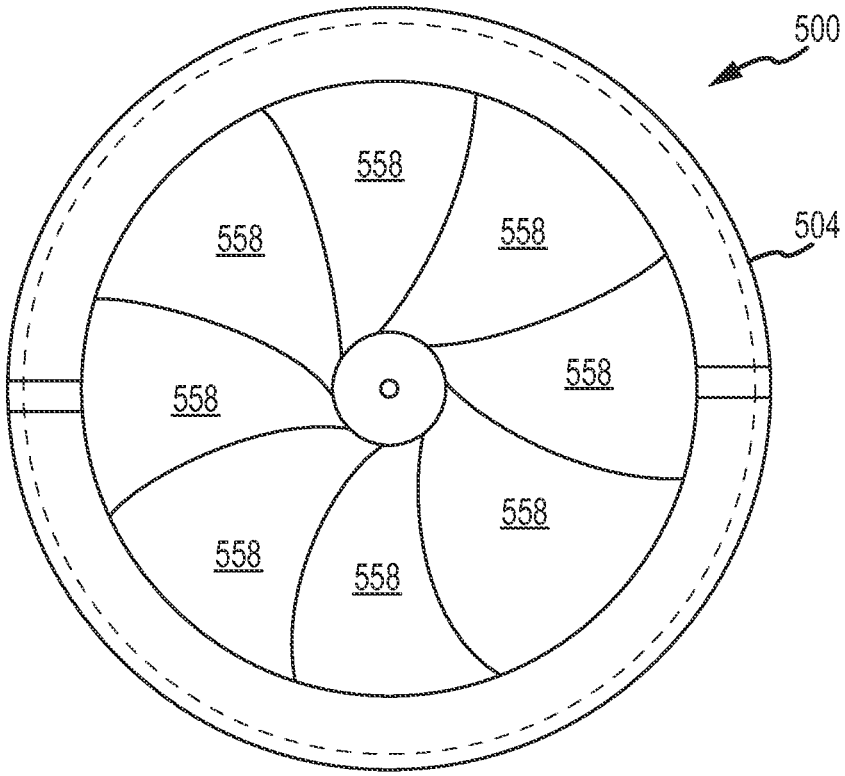
FIG. 5D is a bottom view of the orifice plate of FIG. 5C.

FIGS. 5C-5D show another embodiment of an orifice plate 550 that may be installed in the orifice plate receiver hole 242 of a fixture 202 such as shown in FIGS. 2A-2C. The orifice plate 550 includes an adjustable orifice opening 552 that is aligned with the sample exit hole 240 when the orifice plate 550 is installed in the orifice plate receiver hole 242 to permit ionized substances of the sample gas to exit the chamber 230 via the aligned sample exit hole 240 and orifice opening 552. An outer edge 554 of the orifice plate 550 may be configured for securing the orifice plate 550 in the orifice plate receiver hole 242. In this regard, threads may be formed on the outer edge 554 of the orifice plate for mating with corresponding threads formed on a side of the orifice plate receiver hole 242. This allows the orifice plate 550 to be tightly secured in the orifice plate receiver hole 242 such that an o-ring disposed in an o-ring groove 244 formed in the second end 214 of the fixture 202 around the sample exit hole 240 provides a seal between a top surface 556 of the orifice plate 550 and the second end 214 of the fixture 202 in order to prevent ionized substances of the gas sample from escaping around the outer edge 554 of the orifice plate 550.

The orifice opening 552 is defined by a plurality of movable overlapping leaf-like portions 558 that can be positioned to define a continuous range of differently sized orifice openings 552. In this regard, the overlapping leaf-like portions 558 may function in manner similar to the aperture adjustment of a camera lens. The orifice opening 552 defined by the overlapping leaf-like portions 558 may, for example, range in size from about 0.20 mm to about 2.00 mm.

In addition to providing a range of differently sized orifice openings 502, 552, an orifice plate 500, 550 such as illustrated in FIGS. 5A-5B or FIGS. 5C-5D may also help to draw-out and/or focus the ionized substances exiting the chamber 230 of the fixture 202. In this regard, the portion(s) of the orifice plates 500 or 550 defining the orifice openings 502, 552 may be electrically insulated from the fixture 202. This permits an electric potential to be applied to the portion(s) of the orifice plates 500 or 550 defining the orifice openings 502, 552 causing the orifice openings 502, 550 to serve as a focusing lens on the outgoing ionized substances.

Figure 6A:
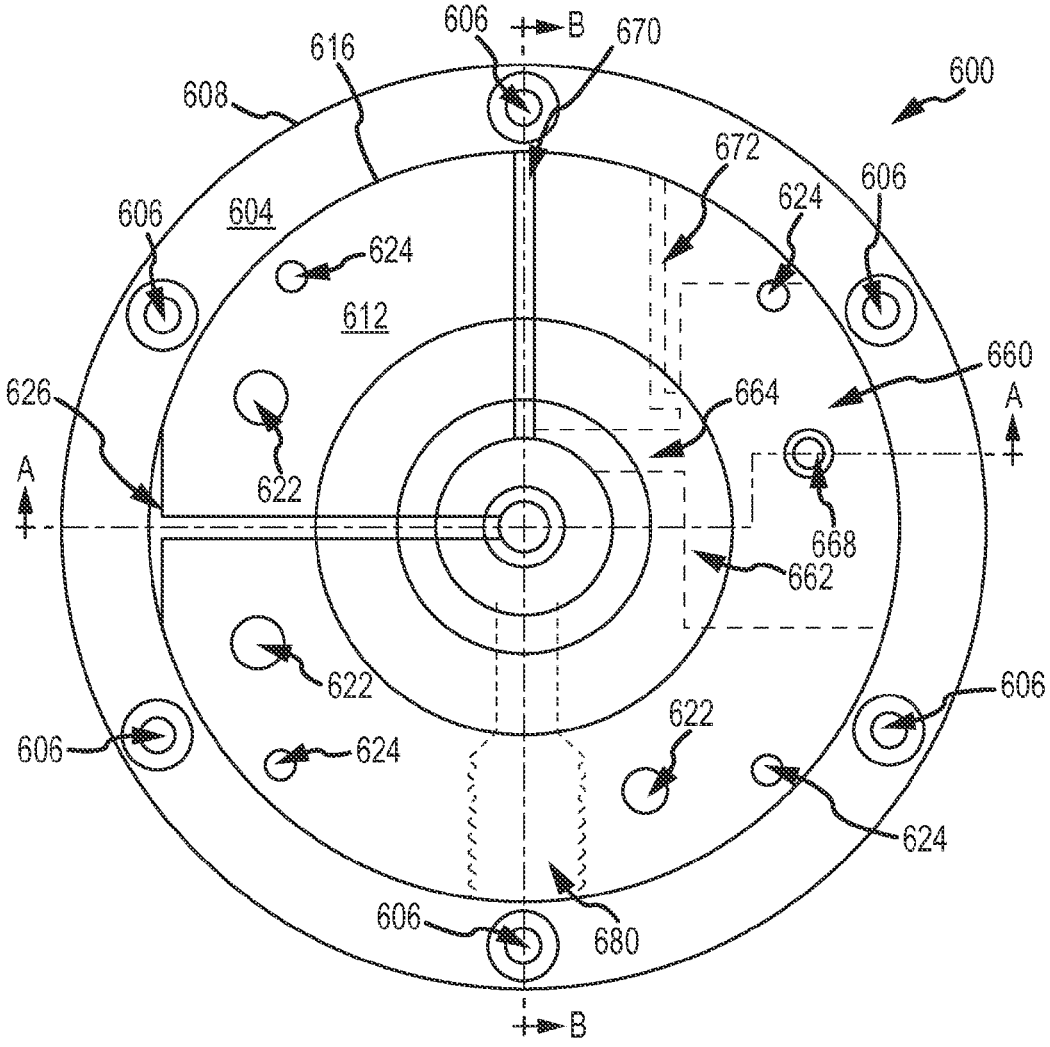
FIG. 6A is a top view of another embodiment of an ionization source.
Figure 6B:
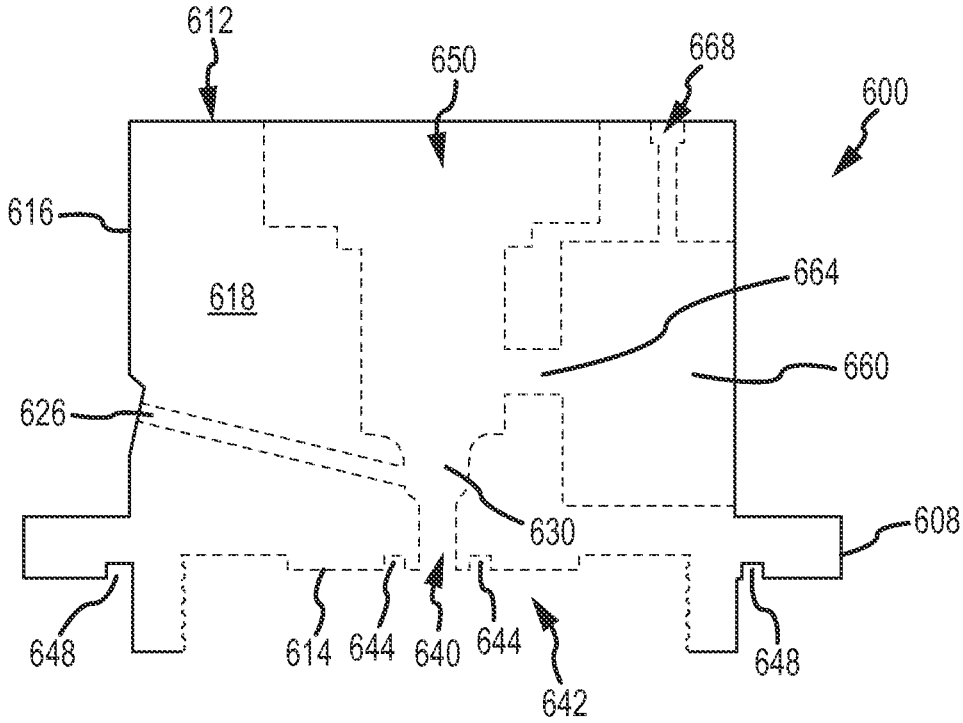
FIG. 6B is a side cross-sectional view of the ionization source taken along line A-A in FIG. 6A.
Figure 6C:
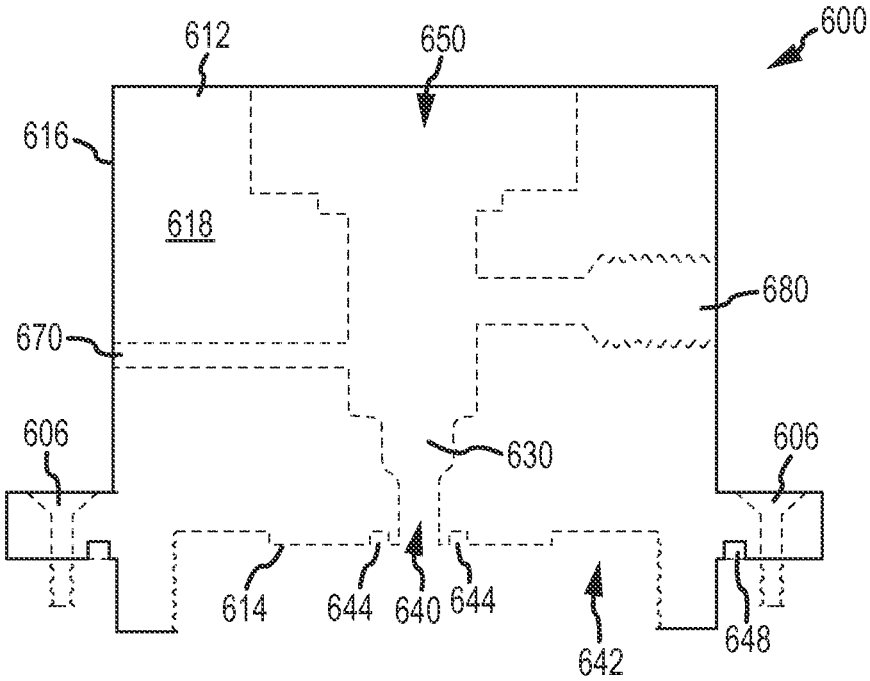
FIG. 6C is a side cross-sectional view of the ionization source taken along line B-B in FIG. 6A.

FIGS. 6A-6C show another embodiment of a low pressure ionization source 600. The low pressure ionization source 600 may be used as the ionization source of an instrument such as illustrated in FIG. 1. The low pressure ionization source 600 shown in FIGS. 6A-6C includes a number of features that are similar to the features of the ionization source of FIGS. 2A-2C and similar features are identified by corresponding reference numerals in the 600's. In the low pressure ionization source 600 of FIGS. 6A-6C, the annular flange portion 604 of the fixture 602 is reduced in diameter as compared with the annular flange portion 204 of fixture 202, and instead of being configured to adapt the second end 214 of the fixture 202 for being secured to the detector/analyzer of a particular model of instrument, the annular flange portion 604 is configured for attachment of an interchangeable adaptor ring 700 such as shown in FIGS. 7A-7B to adapt the second end 614 of the fixture 602 for being secured to the detector/analyzer of a variety of instruments.

Figure 7A:
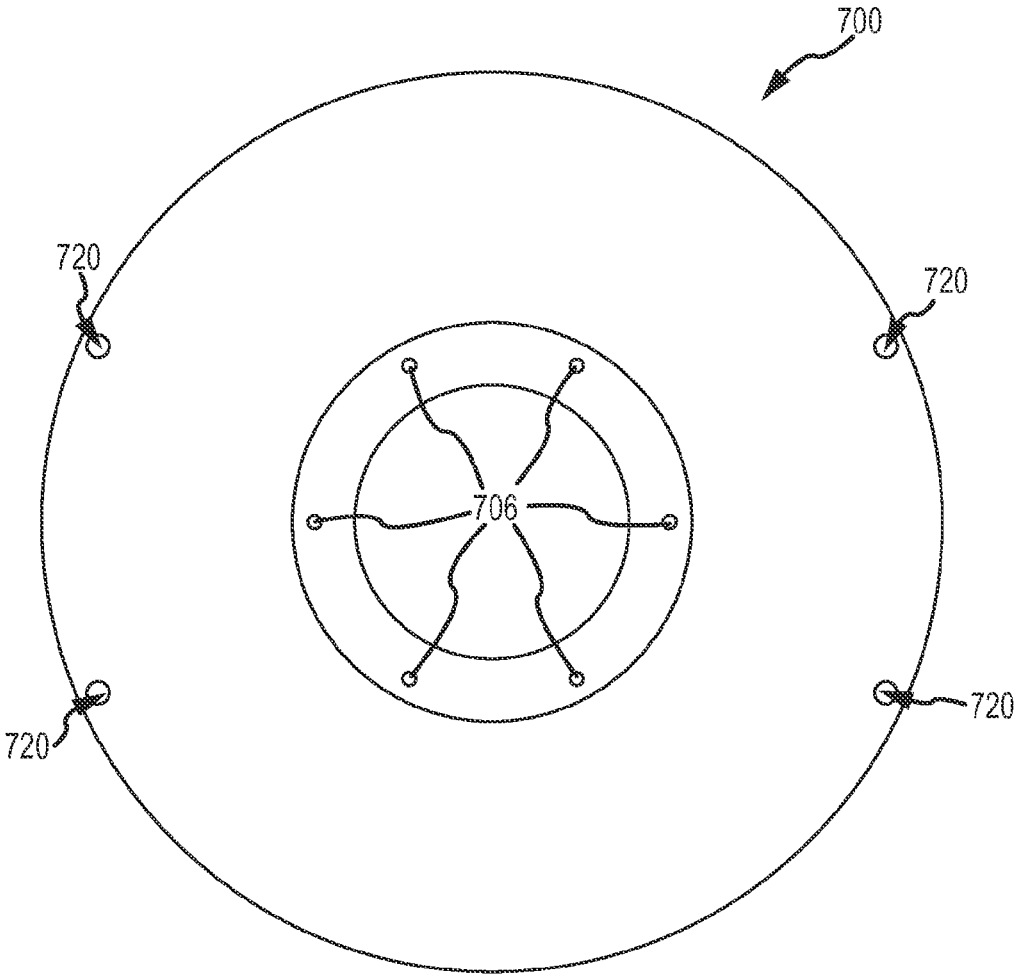
FIG. 7A is a top view of one embodiment of an adaptor ring that may be used with the ionization source of FIGS. 6A-6C and FIGS. 8A-8C.
Figure 7B:
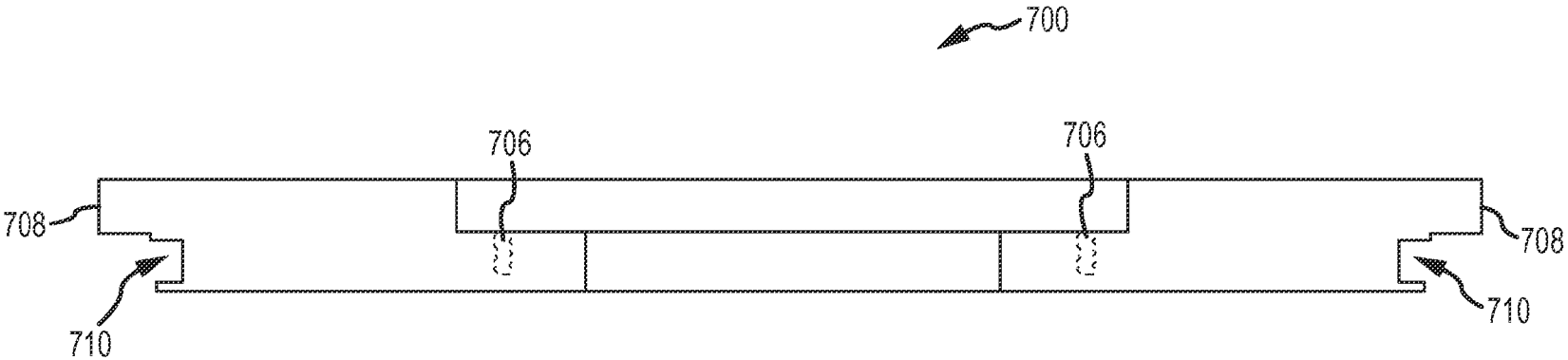
FIG. 7B is a side view of the adaptor ring.

As shown in FIGS. 7A-7B, the adaptor ring 700 includes a plurality of holes 706 formed near an inner edge of the adaptor ring 700. A plurality of holes 606 are formed through the annular flange portion 604 of the fixture 602, and when the adaptor ring 700 is positioned on the second end 214 of the fixture 202. The adaptor ring 700 may be secured to the second end 614 of the fixture 602 with machine screws that extend through the holes 606 in the annular flange portion 604 and threadably engage the corresponding holes 706 in the adaptor ring 700.

A particular adaptor ring 700 is configured for releasably securing the fixture 602 to the detector/analyzer unit of a particular model instrument. In this regard, the adaptor ring 700 may have particular dimensions (e.g., a particular outside diameter, a particular thickness, a particular edge profile) and may include additional holes 720 arrayed to correspond with threaded holes in the detector/analyzer unit that receive machine screws to secure the adaptor ring 700 to the detector/analyzer unit. One configuration of the adaptor ring 700 may easily be changed to a differently configured adaptor ring 700 having, for example, differently arrayed additional holes 720 or different dimensions (e.g., a different outside diameter, a different thickness, a different edge profile) in order to secure the same fixture 602 to the detector/analyzer of a different instrument. A groove 644 formed in the annular flange portion 604 may receive an o-ring that provides a seal between the annular flange portion 604 and the adaptor ring 700. The outer edge 708 of the adaptor ring 700 may include a groove 710 for receiving an o-ring that provides a seal between the adaptor ring 700 and the detector/analyzer unit of the instrument.

Another difference between the ionization source 600 of FIGS. 6A-6C and the ionization source 200 illustrated in FIGS. 2A-2C is the orientation of the first and second sample entrance passageways 626, 670 in the ionization source 600. In the ionization source 200 of FIGS. 2A-2C, the first sample passageway 226 enters the chamber 230 opposite the second sample passageway 270. In the ionization source 600 of FIGS. 6A-6C, the first sample passageway 626 is oriented so that the inlet sample gas stream enters the chamber 630 opposite the light entrance passageway 664 and transverse (e.g., at 90 degrees) to the pressure regulator receiver hole 680, and the second sample passageway 670 is oriented so that the inlet sample gas stream enters the chamber 630 opposite the pressure regulator receiver hole 680 and transverse (e.g., at 90 degrees) to the light entrance passageway 664. In the ionization source 600 of FIGS. 6A-6C, the lamp receiver hole 660 and light entrance passageway 664 are also oriented off-center so that the openings of the light entrance passageway 664 and the second sample entrance passageway 670 into the chamber 630 are adjacent to one another so that all or nearly all of an inlet sample gas stream entering the chamber 630 from the second sample entrance passageway 670 is intersected by the light beam entering the chamber 630 from the light entrance passageway 664. The purge channel 672 for introduction of an inert gas past the window of the photoionization lamp and into the chamber 630 may also run parallel to the second sample entrance passageway 670.

Figure 8A:
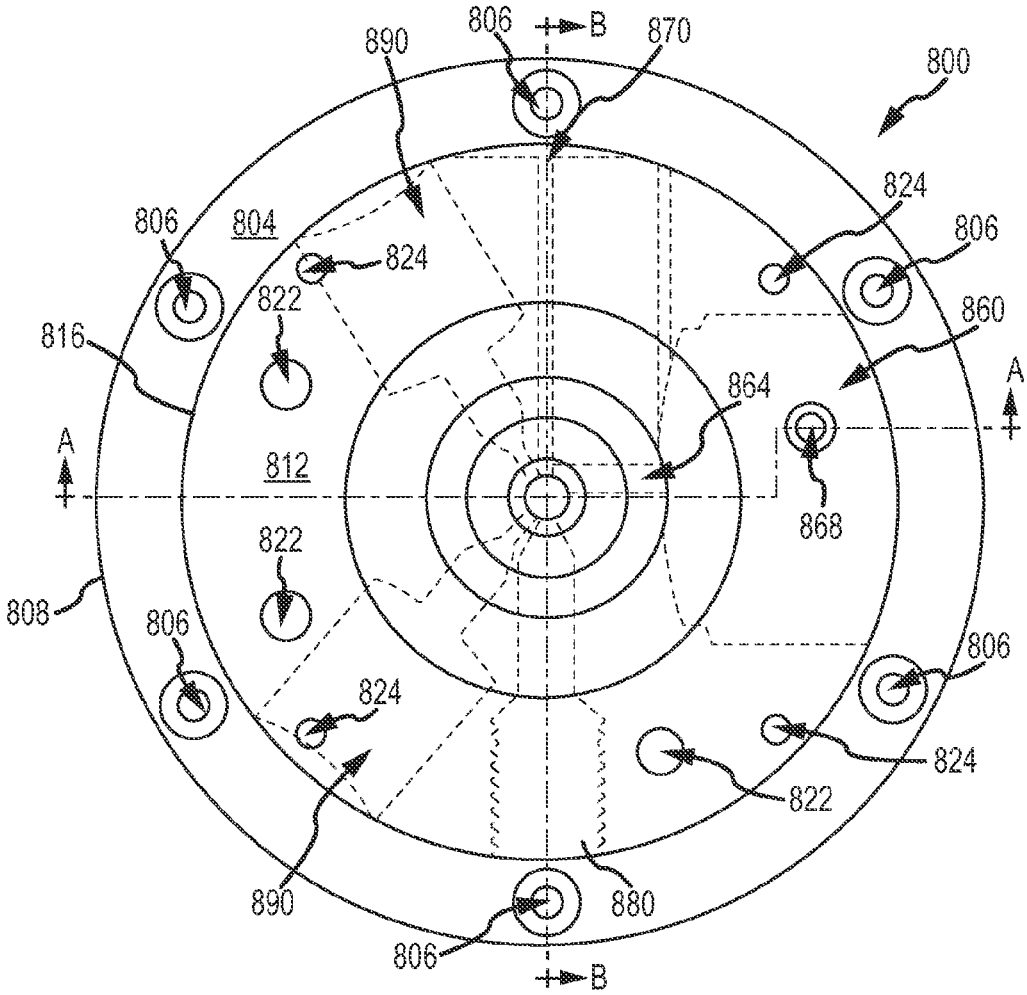
FIG. 8A is a top view of a further embodiment of an ionization source.
Figure 8B:
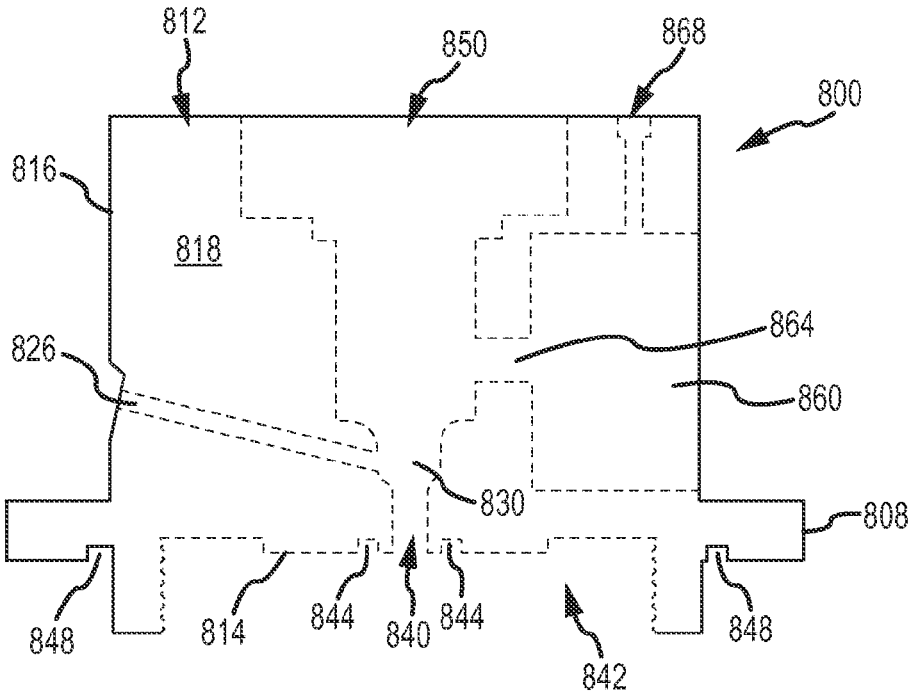
FIG. 8B is a side cross-sectional view of the ionization source taken along line A-A in FIG. 8A.
Figure 8C:
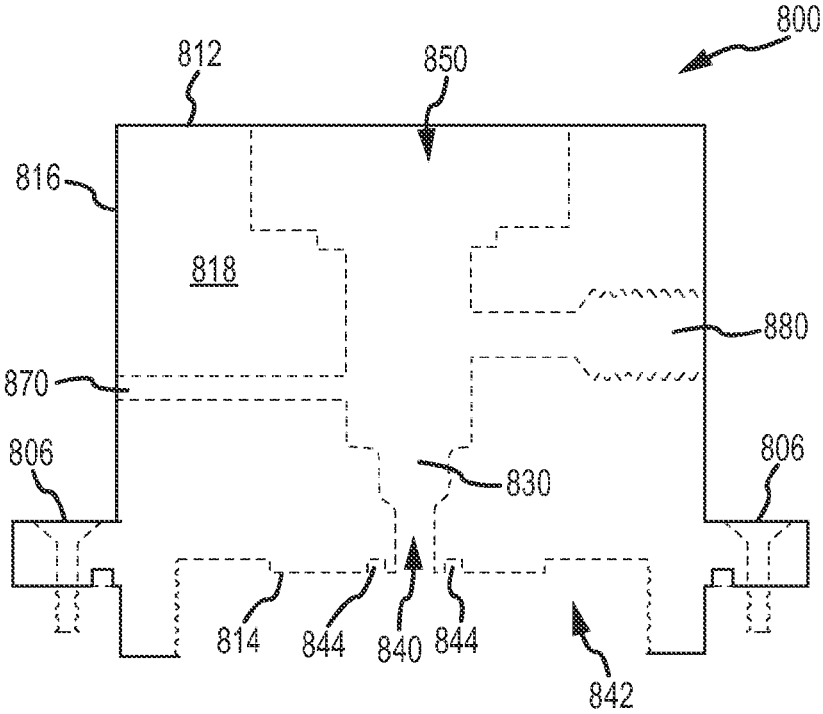
FIG. 8C is a side cross-sectional view of the ionization source taken along line B-Bin FIG. 8A.

FIGS. 8A-8C show another embodiment of a low pressure ionization source 800. The low pressure ionization source 800 may be used as the ionization source of an instrument such as illustrated in FIG. 1. The low pressure ionization source 800 shown in FIGS. 8A-8C includes a number of features that are similar to the features of the ionization source of FIGS. 6A-6C and similar features are identified by corresponding reference numerals in the 800's. For example, the fixture 802 of ionization source 800 is configured to work with an interchangeable adaptor ring 700 such as shown in FIGS. 7A-7B.

Figure 9:
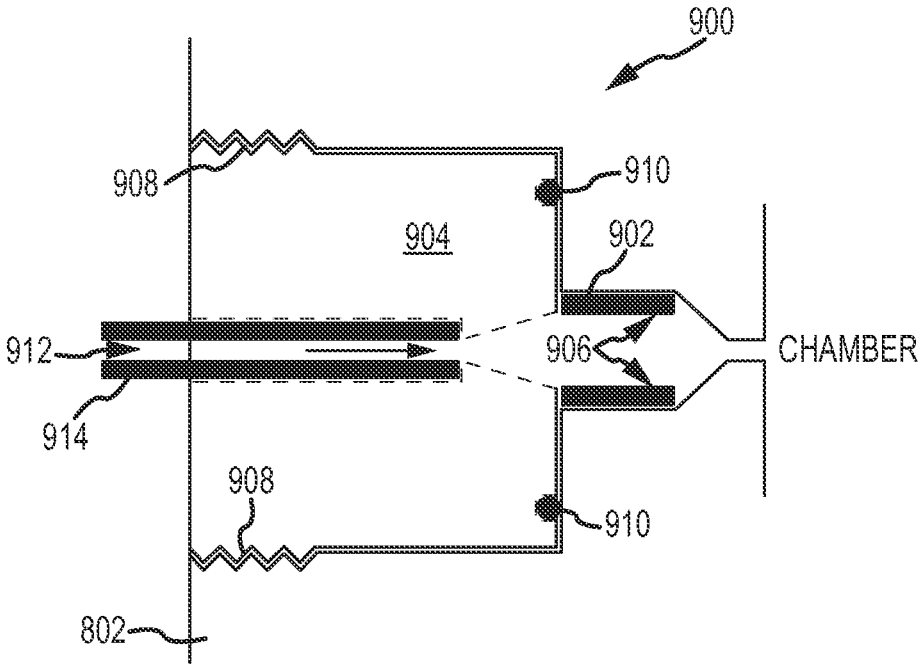
FIG. 9 is a side view of an exemplary radiation source plug that may be installed in an ionization source such as shown in FIGS. 8A-8C.

The ionization source 800 includes at least one, and desirably a pair, of radiation plug receiver holes 890. The radiation plug receiver holes 890 extend from the lateral surface of the fixture 802 inward to the chamber 830. Each hole 890 includes a wider diameter outermost portion 890A, a narrower diameter intermediate portion 890B, and a conically tapered innermost portion 890C narrowing to an opening at the surface of the chamber 830. Each radiation receiver plug hole 890 may have a radiation plug assembly 900 such as shown in FIG. 9 installed therein in order to provide for the introduction of ionizing radiation into the chamber. In this regard, a radiation plug assembly 900 installed in one of the holes 890 may include a beta particle emitter to ionize target substances with a beta particle, and a radiation plug assembly 900 installed in the other hole 890 may include an alpha particle emitter to ionize target substances with an alpha particle. Ionization via a beta particle emitter is selective for target substance that readily accept a negative charge such as, for example, carbon tetrachloride and tetrachloroethane. Ionization via an alpha particle emitter provides ionization for wide variety of substances without the need for producing the relatively high temperatures associated with glow discharge electrode ionization.

When the ionization source 800 is used to ionize substances via a radiation plug assembly 900 installed in one of the radiation plug receiver holes 890, it is possible to install a repeller electrode in the electrode receiver hole 850 to which an electrical potential can be applied in order help drive ionized substances toward the sample exit hole 840. Additionally, when a glow discharge electrode remains in the electric receiver hole 850 during radiation ionization operation of the ionization source 800, a lower electrical potential (e.g., between about 0.1V to 100V) in comparison to the electrical potential that would typically be used during electrode operation can be applied to the glow discharge electrode that remains in the electrode receiver hole 850 causing it to function as a repeller to drive ionized substances toward the sample exit hole 840.

FIG. 9 shows one embodiment of a radiation plug assembly 900 that may be installed in either of the radiation plug receiver holes 890 of the ionization source 800 of FIGS. 8A-8C. The radiation plug assembly 900 includes a support tube 902 and a plug body 904. The support tube includes a radioactive coating 906 (e.g. a beta or an alpha particle emitter) deposited on an inner surface of the support tube 902. The support tube 902 is of an appropriate exterior diameter and length to be disposed in the intermediate portion 890B of the radiation plug receiver hole 890. The plug body 904 is of an appropriate exterior diameter and length to be disposed in the outermost portion 890A of the radiation plug receiver hole 890. The exterior surface of the plug body 904 may include threads 908 for engaging with corresponding threads 892 formed on the surface of the radiation plug receiver hole 890 in order to retain the plug body 904 tightly against the bottom of the outermost portion 890A of the radiation receiver plug hole 890. An o-ring 910 may be positioned between the plug body 904 and the bottom of the radiation receiver plug hole 890 in order to seal the radioactively coated support tube 902 within the fixture 802. Sealing the radiation emitting support tube 902 within the fixture 802 may permit the ionization source 800 to be used in locations and transported between locations without the need for specific permits that might otherwise be required if the radioactive materials were not sealed within the fixture 800.

The plug body 904 may include an inlet passageway 912 that extends from the exterior end of the plug body 904 through to the interior end of the plug body 904. A portion of the inlet passageway 912 may be sized to receive the end of an inlet tube 914. An inlet gas sample stream from the inlet tube 914 may pass through the remainder of the inlet passageway 912 into the radioactively coated support tube 902 thereby directly irradiating the sample stream with alpha or beta particles (depending on which plug the stream passes through) prior to entry of the sample stream to the chamber 830. Another option is to pass a reactant gas (e.g., methane or butane) through the inlet tube 914 and the inlet passageway 912 into the radioactively coated support tube 902 and then into the chamber 890 where the reactant gas mixes with and indirectly irradiates the gas sample entering the chamber 830 via the first or second inlet passageways 826 or 870. Indirect irradiation of the gas sample via an irradiated reactant gas in this manner achieves true chemical ionization of the target substances. Thus, the ionization source 800 may be referred to herein as a low pressure chemical ionization (LPCI) source 800.

Deviations may be made from the specific embodiments disclosed in the specification without departing from the spirit and scope of the invention. For example, at least some of the functionalities performed by many of the processes and modules discussed herein may be performed by other modules, devices, processes, etc. The illustrations and discussion herein has only been provided to assist the reader in understanding the various aspects of the present disclosure.

While this disclosure contains many specifics, these should not be construed as limitations on the scope of the disclosure or of what may be claimed, but rather as descriptions of features specific to particular embodiments of the disclosure. Certain features that are described in this specification in the context of separate embodiments and/or arrangements can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Additionally, the foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

While various embodiments of the present invention have been described in detail, further modifications and adaptations of the invention may occur to those skilled in the art. However, it is to be expressly understood that such modifications and adaptations are within the spirit and scope of the present invention.

What is claimed is:

1. A low pressure ionization source usable with an instrument employing ionized target substances to detect trace atmospheric gases in a gas sample, said source comprising:

a fixture securable to the instrument;

a chamber within said fixture;

at least one sample entrance passageway extending from an outer surface of said fixture to said chamber;

an electrode receiver hole extending from a first end of said fixture to said chamber, said electrode receiver hole being configured to receive an electrode therein;

a lamp receiver hole extending from an outer surface of said fixture to said chamber, said lamp receiver hole being configured to receive a lamp therein; and an ionized sample exit hole extending from said chamber to a second end of said fixture and proximal to a detector/analyzer unit of the instrument when the fixture is secured to the instrument, wherein the gas sample enters said chamber via said at least one sample entrance passageway and is ionized by a selected one of an electric potential and a light beam, wherein said electric potential is induced in said chamber between at least a portion of said fixture and an electrode receivable in said electrode receiver hole and said light beam is introduced in said chamber by a photoionization lamp receivable in said lamp receiver hole, and wherein at least a portion of the ionized gas sample exits said chamber via said exit hole to the detector/analyzer of the instrument.

2. The ionization source of claim 1 wherein said fixture includes a flange formed thereon proximal to said second end, said flange adapting said fixture for being releasably secured to the instrument.

3. The ionization source of claim 1 further comprising an adaptor ring securable to said fixture proximal to said second end, said adaptor ring adapting said fixture for being releasably secured to the instrument and being removable from said fixture to permit securing of a differently configured adaptor ring to said fixture for securing said fixture to a different model instrument.

4. The ionization source of claim 1 wherein said fixture is machined from a single piece of material.

5. The ionization source of claim 4 wherein said material is chemically resistant to interaction with target analytes and ions produced from the target analytes.

6. The ionization source of claim 1 further comprising:

an orifice plate receiver hole formed in the second end of the fixture; and a plurality of orifice plates, wherein each one of said plurality of orifice plates is securable in said orifice plate receiver hole and includes an orifice opening therethrough aligned with said ionized sample exit hole when secured in said orifice plate receiver hole.

7. The ionization source of claim 6 wherein said plurality of orifice plates include orifice openings having diameters ranging in size from about 0.20 mm to 2.00 mm.

8. The ionization source of claim 1 further comprising:

an orifice plate receiver hole formed in the second end of the fixture; and an orifice plate securable in said orifice plate receiver hole and having an orifice opening therethrough aligned with said ionized sample exit hole when secured in said orifice plate receiver hole, wherein a diameter of said orifice opening in said orifice plate is variable.

9. The ionization source of claim 8 wherein said orifice opening is variable from about 0.20 mm to about 2.00 mm.

10. The ionization source of claim 1 further comprising:

a pressure controller receiver hole extending from an outer surface of said fixture to said chamber, said pressure controller receiver hole being configured to receive a pressure controller therein.

11. The ionization source of claim 1 further comprising:

at least one radiation source plug receiver hole extending from an outer surface of said fixture to said chamber, said radiation source plug receiver hole being configured to receive a radiation source plug therein for irradiating the gas sample in said chamber.

12. The ionization source of claim 1 further comprising:

an electrode receiver hole plug configured for securing in said electrode receiver hole when ionization of the gas sample by a light beam introduced in said chamber by a photoionization lamp is selected; and a lamp receiver hole plug configured for securing in said lamp receiver hole when ionization of the gas sample by an electric potential introduced in said chamber by an electrode is selected.

13. The ionization source of claim 1 wherein said electrode comprises a glow-discharge electrode.

14. The ionization source of claim 1 wherein said lamp receiver hole is aligned such that a light beam from a photoionization lamp receivable in said lamp receiver hold is directed at the location of an opening of said entrance passageway into said chamber.

15. The ionization source of claim 1 wherein an operating pressure in said chamber is less than about 10 Torr.

16. A method of ionizing a gas sample for detection of trace atmospheric gases in the gas sample using an instrument, said method comprising:

securing a fixture to the instrument, wherein the fixture includes:

a chamber defined therein;

at least one sample entrance passageway extending from an outer surface of the fixture to the chamber;

an electrode receiver hole extending from a first end of the fixture to the chamber, a lamp receiver hole extending from an outer surface of the fixture to the chamber; and an ionized sample exit hole extending from the chamber to a second end of the fixture and proximal to a detector/analyzer unit of the instrument when the fixture is secured to the instrument;

installing at least one of an electrode in the electrode receiver hole and a photoionization lamp in the lamp receiver hole;

introducing a gas sample into the chamber via the at least one entrance passageway; and ionizing at least a portion of the gas sample entering the chamber by operating a selected one of the electrode and the photoionization lamp, wherein the electrode induces an electric potential between at least a portion of the fixture and the electrode and the photoionization lamp introduces a light beam in the chamber, wherein at least a portion of the ionized gas sample exits from the chamber via the sample exit hole toward the detector/analyzer unit of the instrument.

17. The method of claim 16 further comprising:

installing an electrode receiver hole plug in the electrode receiver hole when an ionization lamp is to be selected for ionizing the gas sample; and installing a lamp receiver hole plug in the lamp receiver hole when an electrode is to be selected for ionizing the gas sample.

18. The method of claim 16 further comprising:

installing a pressure controller in a pressure controller receiver hole extending from an outer surface of the fixture to the chamber;

operating the pressure controller to maintain a pressure of about 10 Torr or less in the chamber.

19. The method of claim 16 further comprising:

installing a radiation source plug in a radiation source plug receiver hole extending from an outer surface of the fixture to the chamber, the radiation source plug therein irradiating the gas sample introduced in the chamber.

20. The method of claim 16 further comprising:

installing a selected one of a plurality of orifice plates in an orifice plate receiver hole formed in the second end of the fixture, wherein each one of the plurality of orifice plates includes an orifice opening therethrough aligned with the ionized sample exit hole when installed in the orifice plate receiver hole.

21. The method of claim 20 wherein, in said step of installing, the plurality of orifice plates include orifice openings having diameters ranging in size from about 0.20 mm to about 2.00 mm.

22. The method of claim 16 further comprising:

installing an orifice plate in an orifice plate receiver hole formed in the second end of the fixture, wherein the orifice plate includes an orifice opening therethrough aligned with the ionized sample exit hole when installed in the orifice plate receiver hole, and wherein a diameter of said orifice opening in said orifice plate is variable.

23. The method of claim 22 wherein the orifice opening is variable from about 0.20 mm to 2.00 mm.

24. The method of claim 16 wherein in said step of introducing a gas sample into the chamber via the at least one entrance passageway, the gas sample is directed past the face of the photoionization lamp.

25. The method of claim 16 further comprising:

installing both of an electrode in the electrode receiver hole and a photoionization lamp in the lamp receiver hole;

leaving the electrode in the electrode receiver hole when the ionization lamp is to be selected for ionizing the gas sample; and operating the electrode as a repeller when the ionization lamp is operated to ionize the gas sample.

* * * * *